US009190013B2

(12) United States Patent
Bastani et al.

(10) Patent No.: US 9,190,013 B2
(45) Date of Patent: Nov. 17, 2015

(54) IMAGE-DEPENDENT TEMPORAL SLOT DETERMINATION FOR MULTI-STATE IMODS

(71) Applicant: QUALCOMM MEMS Technologies, Inc., San Diego, CA (US)

(72) Inventors: Pouya Bastani, Vancouver (CA); Alok Govil, Fremont, CA (US); Behnam Bastani, San Jose, CA (US)

(73) Assignee: Qualcomm MEMS Technologies, Inc., San Diego, CA (US)

( * ) Notice: Subject to any disclaimer, the term of this patent is extended or adjusted under 35 U.S.C. 154(b) by 315 days.

(21) Appl. No.: 13/759,271

(22) Filed: Feb. 5, 2013

(65) Prior Publication Data

US 2014/0218418 A1 Aug. 7, 2014

(51) Int. Cl.

| | |
|---|---|
| ***G09G 5/00*** | (2006.01) |
| ***G09G 5/02*** | (2006.01) |
| ***G09G 3/20*** | (2006.01) |
| ***G09G 3/34*** | (2006.01) |

(52) U.S. Cl.

CPC ..... *G09G 5/02* (2013.01); *G09G 3/2003* (2013.01); *G09G 3/2022* (2013.01); *G09G 3/3466* (2013.01); *G09G 2360/16* (2013.01)

(58) Field of Classification Search

CPC . G09G 3/2003; G09G 3/2022; G09G 3/3466; G09G 5/02; G09G 2360/16

See application file for complete search history.

(56) References Cited

U.S. PATENT DOCUMENTS

| | | | | |
|---|---|---|---|---|
| 6,421,141 | B2 * | 7/2002 | Nishikawa | 358/1.9 |
| 7,812,300 | B2 | 10/2010 | Candry et al. | |
| 2006/0256134 | A1 * | 11/2006 | Widdowson | 345/629 |
| 2009/0040133 | A1 | 2/2009 | Clodfelter | |
| 2011/0231763 | A1 * | 9/2011 | Sakaguchi et al. | 715/720 |
| 2011/0234603 | A1 * | 9/2011 | Chui et al. | 345/501 |
| 2012/0038693 | A1 | 2/2012 | Kang et al. | |
| 2012/0162178 | A1 * | 6/2012 | Oh | 345/211 |
| 2012/0175412 | A1 * | 7/2012 | Grabiner et al. | 235/375 |
| 2012/0281031 | A1 * | 11/2012 | Clodfelter | 345/690 |
| 2012/0303160 | A1 * | 11/2012 | Ziegler et al. | 700/259 |

(Continued)

FOREIGN PATENT DOCUMENTS

| | | | |
|---|---|---|---|
| EP | 2439726 | A1 | 4/2012 |
| JP | 11329721 | A | 11/1999 |

OTHER PUBLICATIONS

Majumder A., et al., "Display Gamut Reshaping for Color Emulation and Balancing", IEEE Computer Society Conference on Computer Vision and Pattern Recognition Workshops, 2010, pp. 17-24.

(Continued)

*Primary Examiner* — Joseph Haley

(74) *Attorney, Agent, or Firm* — Weaver Austin Villeneuve & Sampson

(57) ABSTRACT

This disclosure provides systems, methods and apparatus, including computer programs encoded on computer storage media, for selecting a temporal modulation method according to an analysis of image data and for controlling a pixel array according to the temporal modulation method. The analysis may involve analyzing at least one of image content data or image gamut data.

27 Claims, 11 Drawing Sheets

(56) References Cited

U.S. PATENT DOCUMENTS

| | | | | |
|---|---|---|---|---|
| 2013/0106872 | A1* | 5/2013 | Peng et al. | 345/519 |
| 2013/0182017 | A1* | 7/2013 | Govil et al. | 345/690 |
| 2013/0211774 | A1* | 8/2013 | Bentley et al. | 702/145 |
| 2014/0099026 | A1* | 4/2014 | Krishnaswamy et al. | 382/167 |
| 2014/0204114 | A1* | 7/2014 | Zeng et al. | 345/598 |

OTHER PUBLICATIONS

International Search Report and Written Opinion—PCT/US2014/012490—ISA/EPO—Jul. 28, 2014.

Partial International Search Report—PCT/US2014/012490—ISA/EPO—May 2, 2014.

* cited by examiner

800

IMAGE-DEPENDENT TEMPORAL SLOT DETERMINATION FOR MULTI-STATE IMODS

TECHNICAL FIELD

This disclosure relates to electromechanical systems and devices, and more particularly to electromechanical systems for implementing reflective display devices.

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of EMS device is called an interferometric modulator (IMOD). The term IMOD or interferometric light modulator refers to a device that selectively absorbs and/or reflects light using the principles of optical interference. In some implementations, an IMOD display element may include a pair of conductive plates, one or both of which may be transparent and/or reflective, wholly or in part, and capable of relative motion upon application of an appropriate electrical signal. For example, one plate may include a stationary layer deposited over, on or supported by a substrate and the other plate may include a reflective membrane separated from the stationary layer by an air gap. The position of one plate in relation to another can change the optical interference of light incident on the IMOD display element. IMOD-based display devices have a wide range of applications, and are anticipated to be used in improving existing products and creating new products, especially those with display capabilities.

Some IMODs are bi-stable IMODs, meaning that they can be configured in only two positions, open or closed. A single image pixel will typically include three or more bi-stable IMODs, each of which corresponds to a subpixel. In a display device that includes multi-state interferometric modulators (MS-IMODs) or analog IMODs (A-IMODs), a pixel's reflective color may be determined by the gap spacing or "gap height" between an absorber stack and a reflector stack of a single IMOD. Some A-IMODs may be positioned in a substantially continuous manner between a large number of gap heights, whereas MS-IMODs may generally be positioned in a smaller number of gap heights. As a result, an A-IMOD may be considered as a special case of the class of MS-IMODs—that is, as an MS-IMOD with a very large number of controllable gap heights. Accordingly, A-IMODs and MS-IMODs are both referred to herein as MS-IMODs.

Although previous versions of MS-IMODs could provide generally satisfactory performance, improved devices and methods would be desirable.

SUMMARY

The systems, methods and devices of this disclosure each have several innovative aspects, no single one of which is solely responsible for the desirable attributes disclosed herein.

One innovative aspect of the subject matter described in this disclosure can be implemented in a display device that includes an array of pixels and a control system. In some implementations, the pixels may include multi-state interferometric modulators (MS-IMODs). Each of the pixels in the array of pixels may be configured to produce a plurality of primary colors including black. The control system may be configured for receiving image data and analyzing the image data to produce image analysis data. The control system may be configured for selecting a temporal modulation method based at least in part on the image analysis data and for controlling the pixels according to the temporal modulation method to produce a color palette that includes the primary colors and a plurality of colors that are intermediate between the primary colors.

In some implementations, the analyzing process may involve analyzing at least one of image content data or image gamut data. The control system may be configured for selecting the temporal modulation method based on receiving and analyzing a single frame of image data and/or based on receiving and analyzing multiple frames of image data. The analyzing process may include a motion analysis of one or more objects in the multiple frames of image data.

The analyzing process may involve determining an image gamut distribution of the image data and sampling the image gamut distribution to produce an image gamut data volume.

The selecting process may involve comparing the image gamut data volume with a plurality of color palette data volumes. Each of the color palette data volumes may correspond to a temporal modulation method. Selecting a temporal modulation method may involve accessing a data structure, such as a look-up table, that includes data corresponding to a plurality of temporal modulation methods.

In some implementations, the analyzing process may involve performing a saliency analysis on the image data to determine salient areas and determining an image gamut distribution of the salient areas. The salient areas may correspond to features of a human or animal. For example, the features may include facial features.

The control system may include a processor, a driver circuit configured to send at least one signal to a display of the display device and a controller configured to send at least a portion of the image data to the driver circuit. The control system may include an image source module configured to send the image data to the processor. The image source module may include a receiver, a transceiver or a transmitter. The display device also may include an input device configured to receive input data and to communicate the input data to the control system.

Another innovative aspect of the subject matter described in this disclosure can be implemented in a display device that includes an array of display elements and a control system. The array of display elements may be configured to produce two or more primary colors. Each primary color may have a fixed grey level without temporal modulation. The grey level of each primary color may be adjusted using temporal modulation. The control system may be configured for receiving image data and for analyzing the image data to produce image analysis data. The control system may be configured for selecting a temporal modulation method based at least in part on the image analysis data and for controlling the display elements according to the temporal modulation method to produce a color palette that includes the primary colors and a plurality of colors that are intermediate between the primary colors.

In some implementations, the analyzing process may involve analyzing at least one of image content data or image gamut data.

The analyzing process may involve determining an image gamut distribution of the image data and sampling the image gamut distribution to produce an image gamut data volume. The selecting process may involve comparing the image gamut data volume with a plurality of color palette data volumes. Each of the color palette data volumes may correspond to a temporal modulation method.

Another innovative aspect of the subject matter described in this disclosure can be implemented in a method that may involve receiving image data, analyzing the image data to produce image analysis data, selecting a temporal modulation method based at least in part on the image analysis data and controlling a plurality of pixels according to the temporal modulation method to produce a color palette. The color palette may include primary colors and a plurality of colors that are intermediate between the primary colors.

In some implementations, the analyzing process may involve analyzing image content data and/or image gamut data. For example, the analyzing process may involve determining an image gamut distribution of the image data and sampling the image gamut distribution to produce an image gamut data volume. The selecting process may involve comparing the image gamut data volume with a plurality of color palette data volumes. Each of the color palette data volumes may correspond to a temporal modulation method. Some implementations may involve performing a saliency analysis on the image data to determine salient areas and determining an image gamut distribution of the salient areas.

Another innovative aspect of the subject matter described in this disclosure can be implemented in a non-transitory medium having software stored thereon. The software may include instructions for controlling a display device to receive image data, to analyze the image data to produce image analysis data and to select a temporal modulation method based, at least in part, on the image analysis data. The software may include instructions for controlling the display device to control a plurality of pixels according to the temporal modulation method to produce a color palette that includes primary colors and a plurality of colors that are intermediate between the primary colors.

In some implementations, the analyzing process may involve analyzing image content data and/or image gamut data. The analyzing process may involve determining an image gamut distribution of the image data and sampling the image gamut distribution to produce an image gamut data volume. The selecting process may involve comparing the image gamut data volume with a plurality of color palette data volumes. Each of the color palette data volumes may correspond to a temporal modulation method.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
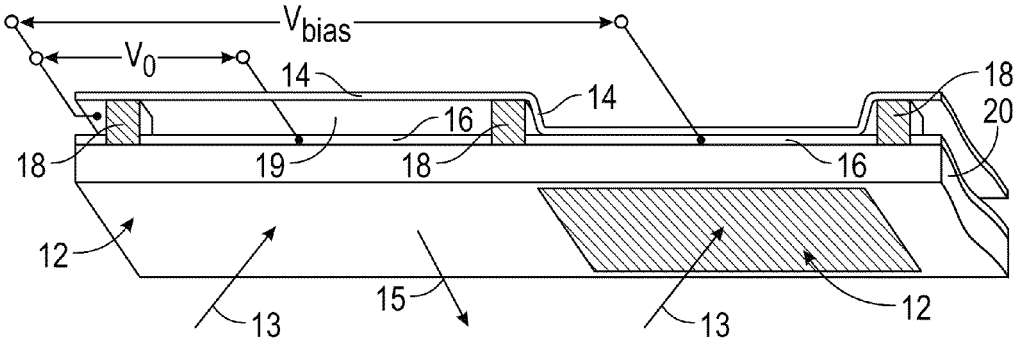
FIG. 1 is an isometric view illustration depicting two adjacent interferometric modulator (IMOD) display elements in a series or array of display elements of an IMOD display device.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (e.g., e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

Temporal modulation methods generally involve controlling pixels or subpixels of a display to produce one or more of a predetermined number of colors during a fixed number of time slots, the duration of each time slot being predetermined. Different temporal slot ratios yield different color palettes. While a given set of time slots may produce a color palette that is suitable for rendering some colors (e.g. dark colors), the same color palette may lead to poor rendering of some other colors (e.g. skin tones) due to the presence of so called "holes" in the color palette (i.e. regions in color space, sRGB, from which the closest palette color is relatively far). Various implementations described herein involve display devices that may be configured to analyze image data, to select a temporal modulation method according to the analysis and to control an MS-IMOD display according to the temporal modulation method.

Particular implementations of the subject matter described in this disclosure can be implemented to realize one or more of the following potential advantages. By reducing or eliminating the amount of spatial dithering, which involves combining the colors of neighboring MS-IMODs, the methods and devices described herein may increase spatial resolution and/or reduce dither artifacts. Adaptively selecting a temporal modulation method according to image data allows the color palette corresponding to the temporal modulation method to be appropriate for the image to be rendered on a display.

An example of a suitable EMS or MEMS device or apparatus, to which the described implementations may apply, is a reflective display device. Reflective display devices can incorporate interferometric modulator (IMOD) display elements that can be implemented to selectively absorb and/or reflect light incident thereon using principles of optical interference. IMOD display elements can include a partial optical absorber, a reflector that is movable with respect to the absorber, and an optical resonant cavity defined between the absorber and the reflector. In some implementations, the reflector can be moved to two or more different positions, which can change the size of the optical resonant cavity and thereby affect the reflectance of the IMOD. The reflectance spectra of IMOD display elements can create fairly broad spectral bands that can be shifted across the visible wavelengths to generate different colors. The position of the spectral band can be adjusted by changing the thickness of the optical resonant cavity. One way of changing the optical resonant cavity is by changing the position of the reflector with respect to the absorber.

FIG. 1 is an isometric view illustration depicting two adjacent interferometric modulator (IMOD) display elements in a series or array of display elements of an IMOD display device. The IMOD display device includes one or more interferometric EMS, such as MEMS, display elements. In these devices, the interferometric MEMS display elements can be configured in either a bright or dark state. In the bright ("relaxed," "open" or "on," etc.) state, the display element reflects a large portion of incident visible light. Conversely, in the dark ("actuated," "closed" or "off," etc.) state, the display element reflects little incident visible light. MEMS display elements can be configured to reflect predominantly at particular wavelengths of light allowing for a color display in addition to black and white. In some implementations, by using multiple display elements, different intensities of color primaries and shades of gray can be achieved.

The IMOD display device can include an array of IMOD display elements which may be arranged in rows and columns. Each display element in the array can include at least a pair of reflective and semi-reflective layers, such as a movable reflective layer (i.e., a movable layer, also referred to as a mechanical layer) and a fixed partially reflective layer (i.e., a stationary layer), positioned at a variable and controllable distance from each other to form an air gap (also referred to as an optical gap, cavity or optical resonant cavity). The movable reflective layer may be moved between at least two positions. For example, in a first position, i.e., a relaxed position, the movable reflective layer can be positioned at a distance from the fixed partially reflective layer. In a second position, i.e., an actuated position, the movable reflective layer can be positioned more closely to the partially reflective layer. Incident light that reflects from the two layers can interfere constructively and/or destructively depending on the position of the movable reflective layer and the wavelength(s) of the incident light, producing either an overall reflective or non-reflective state for each display element. In some implementations, the display element may be in a reflective state when unactuated, reflecting light within the visible spectrum, and may be in a dark state when actuated, absorbing and/or destructively interfering light within the visible range. In some other implementations, however, an IMOD display element may be in a dark state when unactuated, and in a reflective state when actuated. In some implementations, the introduction of an applied voltage can drive the display elements to change states. In some other implementations, an applied charge can drive the display elements to change states.

The depicted portion of the array in FIG. 1 includes two adjacent interferometric MEMS display elements in the form of IMOD display elements 12. In the display element 12 on the right (as illustrated), the movable reflective layer 14 is illustrated in an actuated position near, adjacent or touching the optical stack 16. The voltage $V_{bias}$ applied across the display element 12 on the right is sufficient to move and also maintain the movable reflective layer 14 in the actuated position. In the display element 12 on the left (as illustrated), a movable reflective layer 14 is illustrated in a relaxed position at a distance (which may be predetermined based on design parameters) from an optical stack 16, which includes a partially reflective layer. The voltage $V_0$ applied across the display element 12 on the left is insufficient to cause actuation of the movable reflective layer 14 to an actuated position such as that of the display element 12 on the right.

In FIG. 1, the reflective properties of IMOD display elements 12 are generally illustrated with arrows indicating light 13 incident upon the IMOD display elements 12, and light 15 reflecting from the display element 12 on the left. Most of the light 13 incident upon the display elements 12 may be transmitted through the transparent substrate 20, toward the optical stack 16. A portion of the light incident upon the optical stack 16 may be transmitted through the partially reflective layer of the optical stack 16, and a portion will be reflected back through the transparent substrate 20. The portion of light 13 that is transmitted through the optical stack 16 may be reflected from the movable reflective layer 14, back toward (and through) the transparent substrate 20. Interference (constructive and/or destructive) between the light reflected from the partially reflective layer of the optical stack 16 and the light reflected from the movable reflective layer 14 will determine in part the intensity of wavelength(s) of light 15 reflected from the display element 12 on the viewing or substrate side of the device. In some implementations, the transparent substrate 20 can be a glass substrate (sometimes referred to as a glass plate or panel). The glass substrate may be or include, for example, a borosilicate glass, a soda lime glass, quartz, Pyrex, or other suitable glass material. In some implementations, the glass substrate may have a thickness of 0.3, 0.5 or 0.7 millimeters, although in some implementations the glass substrate can be thicker (such as tens of millimeters) or thinner (such as less than 0.3 millimeters). In some implementations, a non-glass substrate can be used, such as a polycarbonate, acrylic, polyethylene terephthalate (PET) or polyether ether ketone (PEEK) substrate. In such an implementation, the non-glass substrate will likely have a thickness of less than 0.7 millimeters, although the substrate may be thicker depending on the design considerations. In some implementations, a non-transparent substrate, such as a metal foil or stainless steel-based substrate can be used. For example, a reverse-IMOD-based display, which includes a fixed reflective layer and a movable layer which is partially transmissive and partially reflective, may be configured to be viewed from the opposite side of a substrate as the display elements 12 of FIG. 1 and may be supported by a non-transparent substrate.

The optical stack 16 can include a single layer or several layers. The layer(s) can include one or more of an electrode layer, a partially reflective and partially transmissive layer, and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals (e.g., chromium and/or molybdenum), semiconductors, and dielectrics. The partially reflective layer can be formed of one or more layers of materials, and each of the layers can be formed of a single material or a combination of materials. In some implementations, certain portions of the optical stack 16 can include a single semi-transparent thickness of metal or semiconductor which serves as both a partial optical absorber and electrical conductor, while different, electrically more conductive layers or portions (e.g., of the optical stack 16 or of other structures of the display element) can serve to bus signals between IMOD display elements. The optical stack 16 also can include one or more insulating or dielectric layers covering one or more conductive layers or an electrically conductive/partially absorptive layer.

In some implementations, at least some of the layer(s) of the optical stack 16 can be patterned into parallel strips, and may form row electrodes in a display device as described further below. As will be understood by one having ordinary skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of supports, such as the illustrated posts 18, and an intervening sacrificial material located between the posts 18. When the sacrificial material is etched away, a defined gap 19, or optical cavity, can be formed between the movable reflective layer 14 and the optical stack 16. In some implementations, the spacing between posts 18 may be approximately 1-1000 μm, while the gap 19 may be approximately less than 10,000 Angstroms (Å).

In some implementations, each IMOD display element, whether in the actuated or relaxed state, can be considered as a capacitor formed by the fixed and moving reflective layers. When no voltage is applied, the movable reflective layer 14 remains in a mechanically relaxed state, as illustrated by the display element 12 on the left in FIG. 1, with the gap 19 between the movable reflective layer 14 and optical stack 16. However, when a potential difference, i.e., a voltage, is applied to at least one of a selected row and column, the capacitor formed at the intersection of the row and column electrodes at the corresponding display element becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated display element 12 on the right in FIG. 1. The behavior can be the same regardless of the polarity of the applied potential difference. Though a series of display elements in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. In some implementations, the rows may be referred to as "common" lines and the columns may be referred to as "segment" lines, or vice versa. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
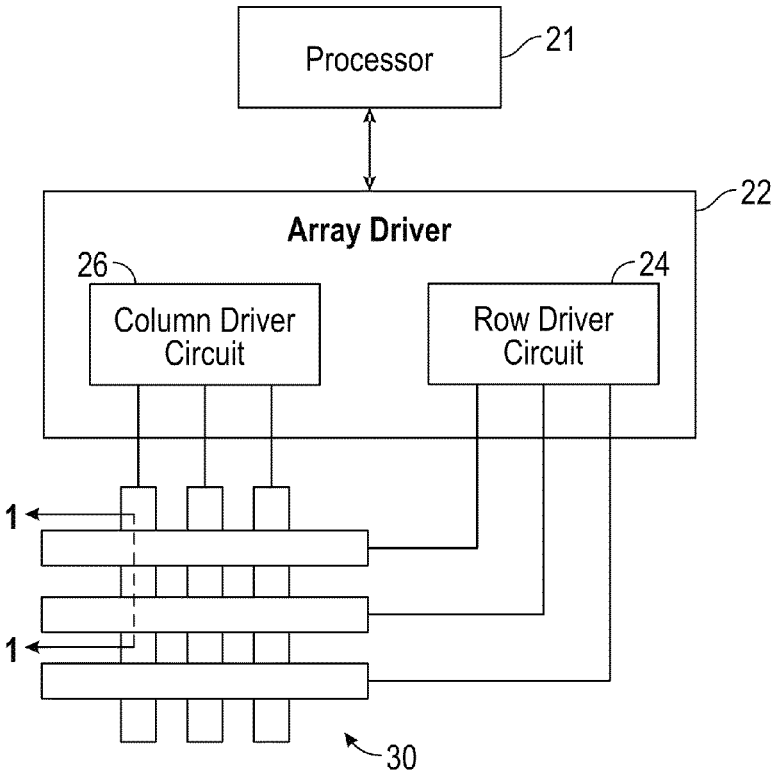
FIG. 2 is a system block diagram illustrating an electronic device incorporating an IMOD-based display including a three element by three element array of IMOD display elements.

FIG. 2 is a system block diagram illustrating an electronic device incorporating an IMOD-based display including a three element by three element array of IMOD display elements. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, for example a display array or panel 30. The cross section of the IMOD display device illustrated in FIG. 1 is shown by the lines 1-1 in FIG. 2. Although FIG. 2 illustrates a 3×3 array of IMOD display elements for the sake of clarity, the display array 30 may contain a very large number of IMOD display elements, and may have a different number of IMOD display elements in rows than in columns, and vice versa.

Figure 3:
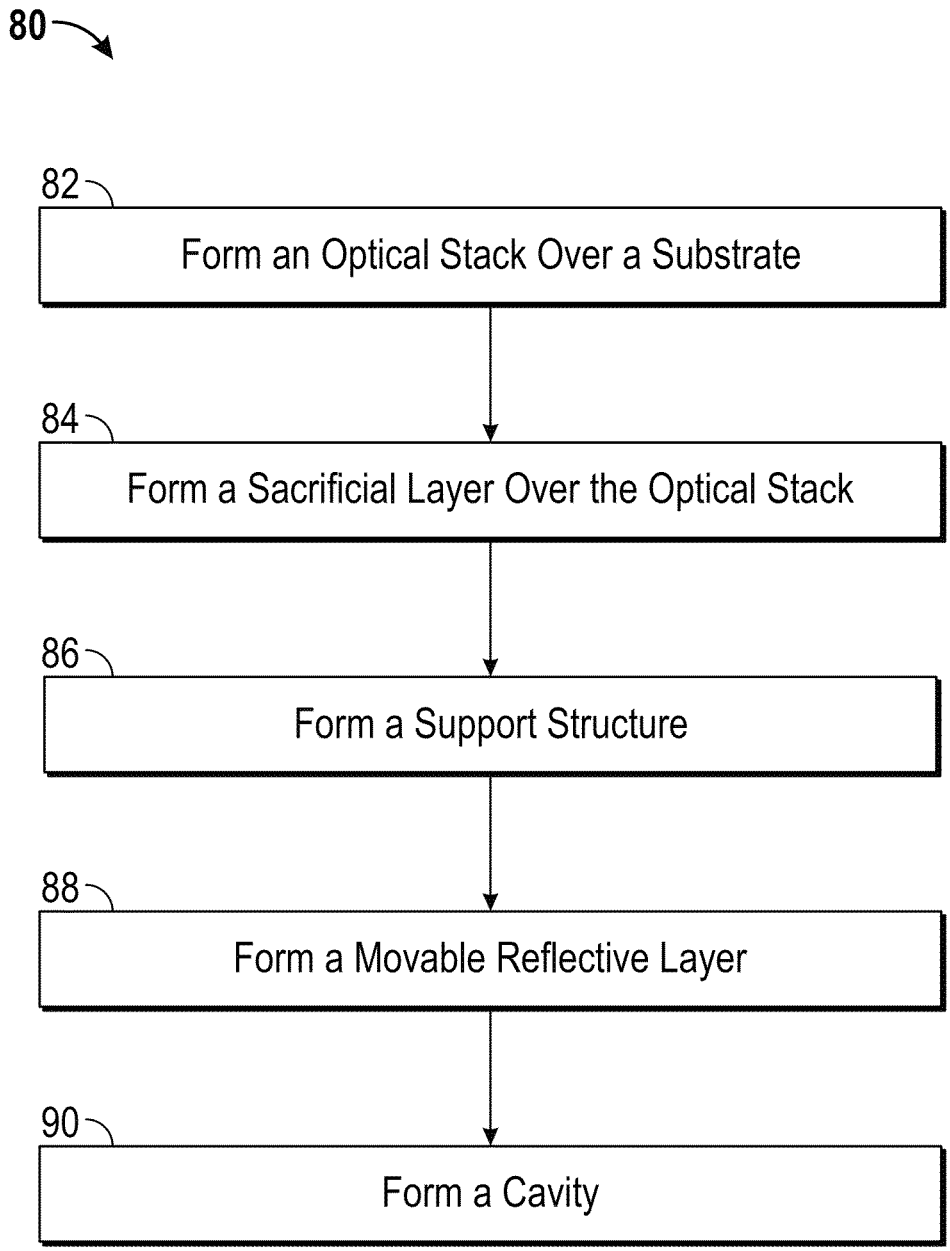
FIG. 3 is a flow diagram illustrating a manufacturing process for an IMOD display or display element.
Figure 4A:
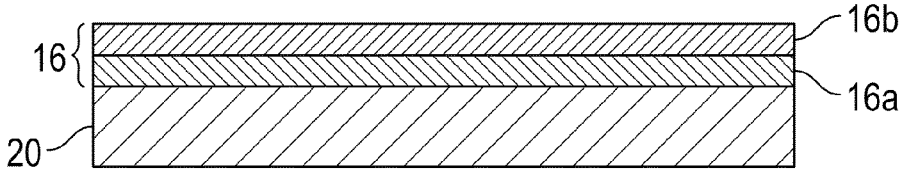
FIGS. 4A-4E are cross-sectional illustrations of various stages in a process of making an IMOD display or display element.

FIG. 3 is a flow diagram illustrating a manufacturing process 80 for an IMOD display or display element. FIGS. 4A-4E are cross-sectional illustrations of various stages in the manufacturing process 80 for making an IMOD display or display element. In some implementations, the manufacturing process 80 can be implemented to manufacture one or more EMS devices, such as IMOD displays or display elements. The manufacture of such an EMS device also can include other blocks not shown in FIG. 3. The process 80 begins at block 82 with the formation of the optical stack 16 over the substrate 20. FIG. 4A illustrates such an optical stack 16 formed over the substrate 20. The substrate 20 may be a transparent substrate such as glass or plastic such as the materials discussed above with respect to FIG. 1. The substrate 20 may be flexible or relatively stiff and unbending, and may have been subjected to prior preparation processes, such as cleaning, to facilitate efficient formation of the optical stack 16. As discussed above, the optical stack 16 can be electrically conductive, partially transparent, partially reflective, and partially absorptive, and may be fabricated, for example, by depositing one or more layers having the desired properties onto the transparent substrate 20.

In FIG. 4A, the optical stack 16 includes a multilayer structure having sub-layers 16*a* and 16*b*, although more or fewer sub-layers may be included in some other implementations. In some implementations, one of the sub-layers 16*a* and 16*b* can be configured with both optically absorptive and electrically conductive properties, such as the combined conductor/absorber sub-layer 16*a*. In some implementations, one of the sub-layers 16*a* and 16*b* can include molybdenum-chromium (molychrome or MoCr), or other materials with a suitable complex refractive index. Additionally, one or more of the sub-layers 16*a* and 16*b* can be patterned into parallel strips, and may form row electrodes in a display device. Such patterning can be performed by a masking and etching process or another suitable process known in the art. In some implementations, one of the sub-layers 16*a* and 16*b* can be an insulating or dielectric layer, such as an upper sub-layer 16*b* that is deposited over one or more underlying metal and/or oxide layers (such as one or more reflective and/or conductive layers). In addition, the optical stack 16 can be patterned into individual and parallel strips that form the rows of the display. In some implementations, at least one of the sub-layers of the optical stack, such as the optically absorptive layer, may be quite thin (e.g., relative to other layers depicted in this disclosure), even though the sub-layers 16*a* and 16*b* are shown somewhat thick in FIGS. 4A-4E.

Figure 4B:
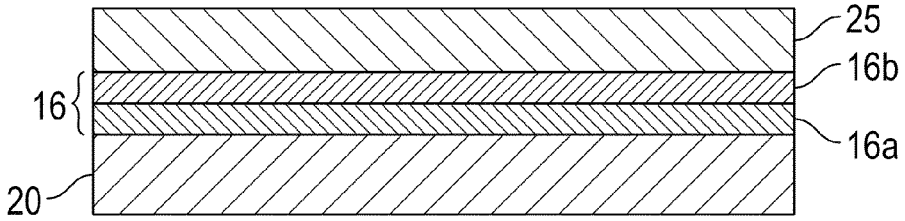

The process 80 continues at block 84 with the formation of a sacrificial layer 25 over the optical stack 16. Because the sacrificial layer 25 is later removed (see block 90) to form the cavity 19, the sacrificial layer 25 is not shown in the resulting IMOD display elements. FIG. 4B illustrates a partially fabricated device including a sacrificial layer 25 formed over the optical stack 16. The formation of the sacrificial layer 25 over the optical stack 16 may include deposition of a xenon difluoride ($XeF_2$)-etchable material such as molybdenum (Mo) or amorphous silicon (Si), in a thickness selected to provide, after subsequent removal, a gap or cavity 19 (see also FIG. 4E) having a desired design size. Deposition of the sacrificial material may be carried out using deposition techniques such as physical vapor deposition (PVD, which includes many different techniques, such as sputtering), plasma-enhanced chemical vapor deposition (PECVD), thermal chemical vapor deposition (thermal CVD), or spin-coating.

Figure 4C:
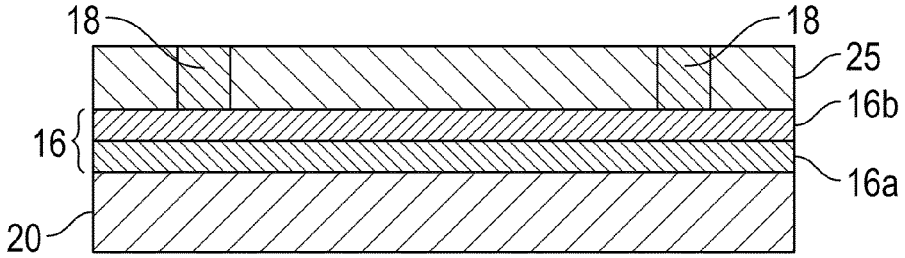
Figure 4D:
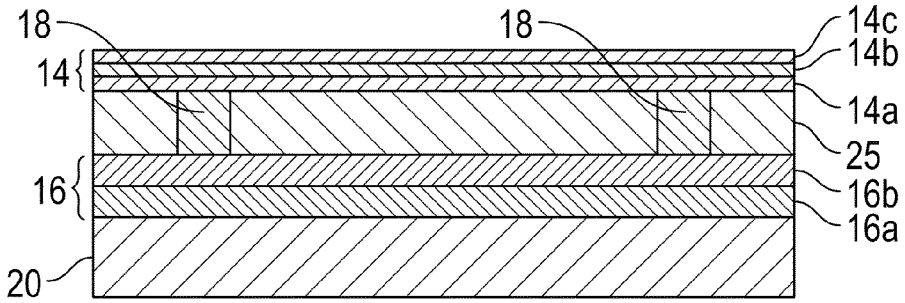
Figure 4E:
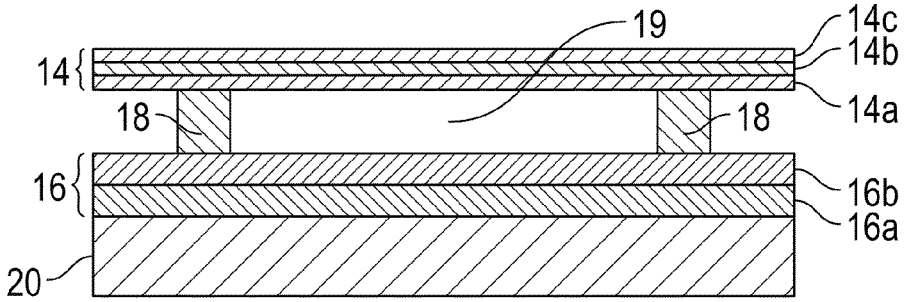

The process 80 continues at block 86 with the formation of a support structure such as a support post 18. The formation of the support post 18 may include patterning the sacrificial layer 25 to form a support structure aperture, then depositing a material (such as a polymer or an inorganic material, like silicon oxide) into the aperture to form the support post 18, using a deposition method such as PVD, PECVD, thermal CVD, or spin-coating. In some implementations, the support structure aperture formed in the sacrificial layer can extend through both the sacrificial layer 25 and the optical stack 16 to the underlying substrate 20, so that the lower end of the support post 18 contacts the substrate 20. Alternatively, as depicted in FIG. 4C, the aperture formed in the sacrificial layer 25 can extend through the sacrificial layer 25, but not through the optical stack 16. For example, FIG. 4E illustrates the lower ends of the support posts 18 in contact with an upper surface of the optical stack 16. The support post 18, or other support structures, may be formed by depositing a layer of support structure material over the sacrificial layer 25 and patterning portions of the support structure material located away from apertures in the sacrificial layer 25. The support structures may be located within the apertures, as illustrated in FIG. 4C, but also can extend at least partially over a portion of the sacrificial layer 25. As noted above, the patterning of the sacrificial layer 25 and/or the support posts 18 can be performed by a masking and etching process, but also may be performed by alternative patterning methods.

The process 80 continues at block 88 with the formation of a movable reflective layer or membrane such as the movable reflective layer 14 illustrated in FIG. 44. The movable reflective layer 14 may be formed by employing one or more deposition steps, including, for example, reflective layer (such as aluminum, aluminum alloy, or other reflective materials) deposition, along with one or more patterning, masking and/or etching steps. The movable reflective layer 14 can be patterned into individual and parallel strips that form, for example, the columns of the display. The movable reflective layer 14 can be electrically conductive, and referred to as an electrically conductive layer. In some implementations, the movable reflective layer 14 may include a plurality of sub-layers 14*a*, 14*b* and 14*c* as shown in FIG. 4D. In some implementations, one or more of the sub-layers, such as sub-layers 14*a* and 14*c*, may include highly reflective sub-layers selected for their optical properties, and another sub-layer 14*b* may include a mechanical sub-layer selected for its mechanical properties. In some implementations, the mechanical sub-layer may include a dielectric material. Since the sacrificial layer 25 is still present in the partially fabricated IMOD display element formed at block 88, the movable reflective layer 14 is typically not movable at this stage. A partially fabricated IMOD display element that contains a sacrificial layer 25 also may be referred to herein as an "unreleased" IMOD.

The process 80 continues at block 90 with the formation of a cavity 19. The cavity 19 may be formed by exposing the sacrificial material 25 (deposited at block 84) to an etchant. For example, an etchable sacrificial material such as Mo or amorphous Si may be removed by dry chemical etching by exposing the sacrificial layer 25 to a gaseous or vaporous etchant, such as vapors derived from solid $XeF_2$ for a period of time that is effective to remove the desired amount of material. The sacrificial material is typically selectively removed relative to the structures surrounding the cavity 19. Other etching methods, such as wet etching and/or plasma etching, also may be used. Since the sacrificial layer 25 is removed during block 90, the movable reflective layer 14 is typically movable after this stage. After removal of the sacrificial material 25, the resulting fully or partially fabricated IMOD display element may be referred to herein as a "released" IMOD.

In some implementations, the packaging of an EMS component or device, such as an IMOD-based display, can include a backplate (alternatively referred to as a backplane, back glass or recessed glass) which can be configured to protect the EMS components from damage (such as from mechanical interference or potentially damaging substances). The backplate also can provide structural support for a wide range of components, including but not limited to driver circuitry, processors, memory, interconnect arrays, vapor barriers, product housing, and the like. In some implementations, the use of a backplate can facilitate integration of components and thereby reduce the volume, weight, and/or manufacturing costs of a portable electronic device.

Figure 5A:
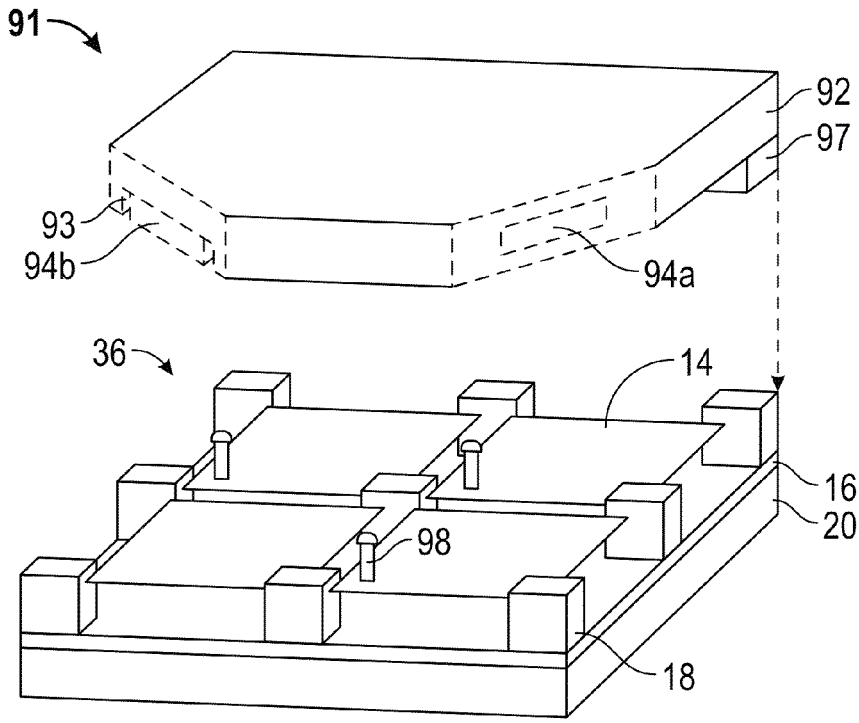
FIGS. 5A and 5B are schematic exploded partial perspective views of a portion of an electromechanical systems (EMS) package including an array of EMS elements and a backplate.
Figure 5B:
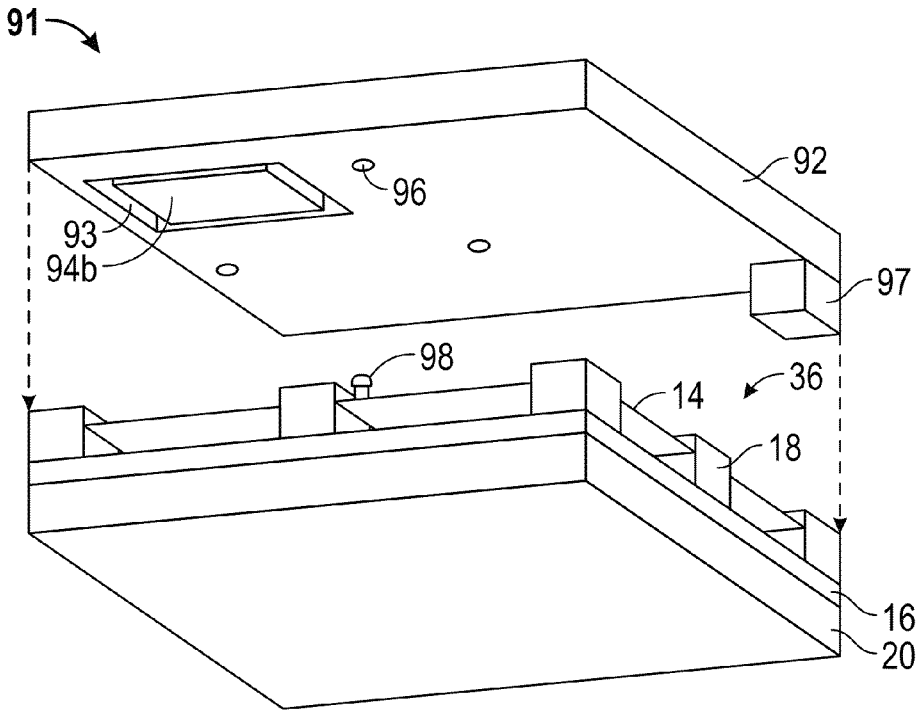

FIGS. 5A and 5B are schematic exploded partial perspective views of a portion of an EMS package 91 including an array 36 of EMS elements and a backplate 92. FIG. 5A is shown with two corners of the backplate 92 cut away to better illustrate certain portions of the backplate 92, while FIG. 5B is shown without the corners cut away. The EMS array 36 can include a substrate 20, support posts 18, and a movable layer 14. In some implementations, the EMS array 36 can include an array of IMOD display elements with one or more optical stack portions 16 on a transparent substrate, and the movable layer 14 can be implemented as a movable reflective layer.

The backplate 92 can be essentially planar or can have at least one contoured surface (e.g., the backplate 92 can be formed with recesses and/or protrusions). The backplate 92 may be made of any suitable material, whether transparent or opaque, conductive or insulating. Suitable materials for the backplate 92 include, but are not limited to, glass, plastic, ceramics, polymers, laminates, metals, metal foils, Kovar and plated Kovar.

As shown in FIGS. 5A and 5B, the backplate 92 can include one or more backplate components 94*a* and 94*b*, which can be partially or wholly embedded in the backplate 92. As can be seen in FIG. 5A, backplate component 94*a* is embedded in the backplate 92. As can be seen in FIGS. 5A and 5B, backplate component 94*b* is disposed within a recess 93 formed in a surface of the backplate 92. In some implementations, the backplate components 94*a* and/or 94*b* can protrude from a surface of the backplate 92. Although backplate component 94*b* is disposed on the side of the backplate 92 facing the substrate 20, in other implementations, the backplate components can be disposed on the opposite side of the backplate 92.

The backplate components 94*a* and/or 94*b* can include one or more active or passive electrical components, such as transistors, capacitors, inductors, resistors, diodes, switches, and/or integrated circuits (ICs) such as a packaged, standard or discrete IC. Other examples of backplate components that can be used in various implementations include antennas, batteries, and sensors such as electrical, touch, optical, or chemical sensors, or thin-film deposited devices.

In some implementations, the backplate components 94*a* and/or 94*b* can be in electrical communication with portions of the EMS array 36. Conductive structures such as traces, bumps, posts, or vias may be formed on one or both of the backplate 92 or the substrate 20 and may contact one another or other conductive components to form electrical connections between the EMS array 36 and the backplate components 94*a* and/or 94*b*. For example, FIG. 5B includes one or more conductive vias 96 on the backplate 92 which can be aligned with electrical contacts 98 extending upward from the movable layers 14 within the EMS array 36. In some implementations, the backplate 92 also can include one or more insulating layers that electrically insulate the backplate components 94*a* and/or 94*b* from other components of the EMS array 36. In some implementations in which the backplate 92 is formed from vapor-permeable materials, an interior surface of backplate 92 can be coated with a vapor barrier (not shown).

The backplate components 94*a* and 94*b* can include one or more desiccants which act to absorb any moisture that may enter the EMS package 91. In some implementations, a desiccant (or other moisture absorbing materials, such as a getter) may be provided separately from any other backplate components, for example as a sheet that is mounted to the backplate 92 (or in a recess formed therein) with adhesive. Alternatively, the desiccant may be integrated into the backplate 92. In some other implementations, the desiccant may be applied directly or indirectly over other backplate components, for example by spray-coating, screen printing, or any other suitable method.

In some implementations, the EMS array 36 and/or the backplate 92 can include mechanical standoffs 97 to maintain a distance between the backplate components and the display elements and thereby prevent mechanical interference between those components. In the implementation illustrated in FIGS. 5A and 5B, the mechanical standoffs 97 are formed as posts protruding from the backplate 92 in alignment with the support posts 18 of the EMS array 36. Alternatively or in addition, mechanical standoffs, such as rails or posts, can be provided along the edges of the EMS package 91.

Although not illustrated in FIGS. 5A and 5B, a seal can be provided which partially or completely encircles the EMS array 36. Together with the backplate 92 and the substrate 20, the seal can form a protective cavity enclosing the EMS array 36. The seal may be a semi-hermetic seal, such as a conventional epoxy-based adhesive. In some other implementations, the seal may be a hermetic seal, such as a thin film metal weld or a glass frit. In some other implementations, the seal may include polyisobutylene (PIB), polyurethane, liquid spin-on glass, solder, polymers, plastics, or other materials. In some implementations, a reinforced sealant can be used to form mechanical standoffs.

In alternate implementations, a seal ring may include an extension of either one or both of the backplate 92 or the substrate 20. For example, the seal ring may include a mechanical extension (not shown) of the backplate 92. In some implementations, the seal ring may include a separate member, such as an O-ring or other annular member.

In some implementations, the EMS array 36 and the backplate 92 are separately formed before being attached or coupled together. For example, the edge of the substrate 20 can be attached and sealed to the edge of the backplate 92 as discussed above. Alternatively, the EMS array 36 and the backplate 92 can be formed and joined together as the EMS package 91. In some other implementations, the EMS package 91 can be fabricated in any other suitable manner, such as by forming components of the backplate 92 over the EMS array 36 by deposition.

FIGS. 6A-6E show examples of how a multi-state IMOD (MS-IMOD) may be configured to produce different colors. As noted above, analog IMODs (A-IMODs) are considered to be examples of the broader class of MS-IMODs.

In an MS-IMOD, a pixel's reflective color may be varied by changing the gap height between an absorber stack and a reflector stack. In FIGS. 6A-6E, the MS-IMOD 600 includes the reflector stack 605 and the absorber stack 610. In this implementation, the absorber stack 610 is partially reflective and partially absorptive. Here, the reflector stack 605 includes at least one metallic reflective layer, which also may be referred to herein as a mirrored surface or a metal mirror.

In some implementations, the absorber layer may be formed of a partially absorptive and partially reflective layer. The absorber layer may be part of an absorber stack that includes other layers, such as one or more dielectric layers, an electrode layer, etc. According to some such implementations, the absorber stack may include a dielectric layer, a metal layer and a passivation layer. In some implementations, the dielectric layer may be formed of $SiO_2$, SiON, $MgF_2$, $Al_2O_3$ and/or other dielectric materials. In some implementations, the metal layer may be formed of Cr, W, Ni, V, Ti, Rh, Pt, Ge, Co and/or MoCr. In some implementations, the passivation layer may include $Al_2O_3$ or another dielectric material.

The mirrored surface may, for example, be formed of a reflective metal such as Al, silver, etc. The mirrored surface may be part of a reflector stack that includes other layers, such as one or more dielectric layers. Such dielectric layers may be formed of $TiO_2$, $Si_3N_4$, $ZrO_2$, $Ta_2O_5$, $Sb_2O_3$, $HfO_2$, $Sc_2O_3$, $In_2O_3$, Sn:$In_2O_3$, $SiO_2$, SiON, $MgF_2$, $Al_2O_3$, $HfF_4$, $YbF_3$, $Na_3AlF_6$ and/or other dielectric materials.

In FIGS. 6A-6E, the reflector stack 605 is shown at five positions relative to the absorber stack 610. However, an MS-IMOD 600 may be movable between substantially more than 5 positions relative to the reflector stack 605. For example, in some A-IMOD implementations, the gap height 630 between the reflector stack 605 and the absorber stack 610 may be varied in a substantially continuous manner. In some such MS-IMODs 600, the gap height 630 may be controlled with a high level of precision, e.g., with an error of 10 nm or less. Although the absorber stack 610 includes a single absorber layer in this example, alternative implementations of the absorber stack 610 may include multiple absorber layers. Moreover, in alternative implementations, the absorber stack 610 may not be partially reflective.

An incident wave having a wavelength $\lambda$ will interfere with its own reflection from the reflector stack 605 to create a standing wave with local peaks and nulls. The first null is $\lambda/2$ from the mirror and subsequent nulls are located at $\lambda/2$ intervals. For that wavelength, a thin absorber layer placed at one of the null positions will absorb very little energy.

Figure 6A:
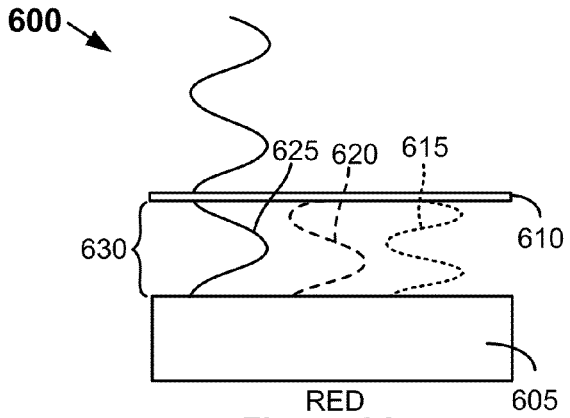
FIGS. 6A-6E show examples of how a multi-state IMOD (MS-IMOD) may be configured to produce different colors.

Referring first to FIG. 6A, when the gap height 630 is substantially equal to the half wavelength of a red wavelength of light 625 (also referred to herein as a red color), the absorber stack 610 is positioned at the null of the red standing wave interference pattern. The absorption of the red wavelength of light 625 is near zero because there is almost no red light at the absorber. At this configuration, constructive interference appears between red wavelengths of light reflected from the absorber stack 610 and red wavelengths of light reflected from the reflector stack 605. Therefore, light having a wavelength substantially corresponding to the red wavelength of light 625 is reflected efficiently. Light of other colors, including the blue wavelength of light 615 and the green wavelength of light 620, has a high intensity field at the absorber and is not reinforced by constructive interference. Instead, such light is substantially absorbed by the absorber stack 610.

Figure 6B:
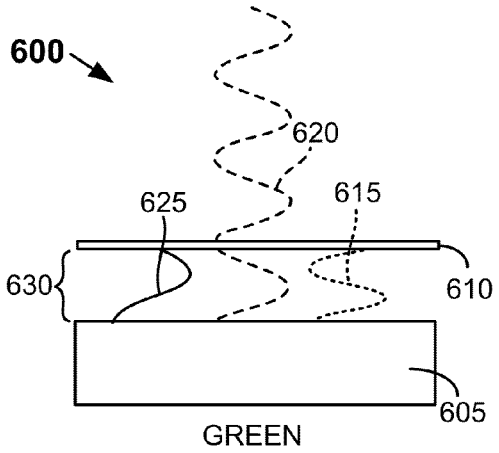

FIG. 6B depicts the MS-IMOD 600 in a configuration wherein the reflector stack 605 is moved closer to the absorber stack 610 (or vice versa). In this example, the gap height 630 is substantially equal to the half wavelength of the green wavelength of light 620. The absorber stack 610 is positioned at the null of the green standing wave interference pattern. The absorption of the green wavelength of light 620 is near zero because there is almost no green light at the absorber. At this configuration, constructive interference appears between green light reflected from the absorber stack 610 and green light reflected from the reflector stack 605. Light having a wavelength substantially corresponding to the green wavelength of light 620 is reflected efficiently. Light of other colors, including the red wavelength of light 625 and the blue wavelength of light 615, is substantially absorbed by the absorber stack 610.

Figure 6C:
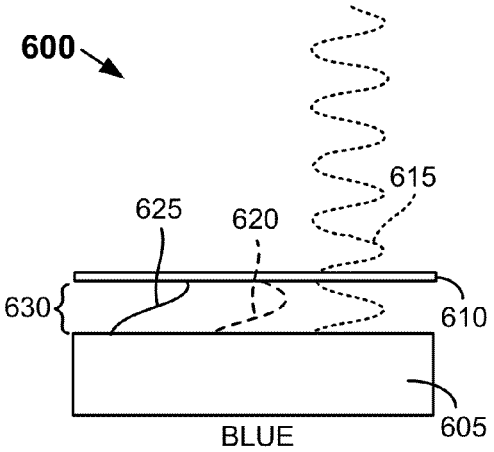

In FIG. 6C, the reflector stack 605 is moved closer to the absorber stack 610 (or vice versa), so that the gap height 630 is substantially equal to the half wavelength of the blue wavelength of light 615. Light having a wavelength substantially corresponding to the blue wavelength of light 615 is reflected efficiently. Light of other colors, including the red wavelength of light 625 and the green wavelength of light 620, is substantially absorbed by the absorber stack 610.

Figure 6D:
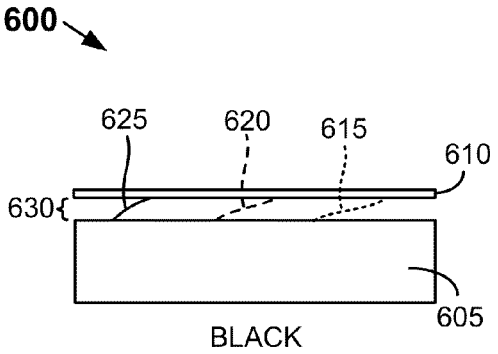

In FIG. 6D, however, the MS-IMOD 600 is in a configuration wherein the gap height 630 is substantially equal to ¼ of the wavelength of the average color in the visible range. In such arrangement, the absorber is located near the intensity peak of the interference standing wave; the strong absorption due to high field intensity together with destructive interference between the absorber stack 610 and the reflector stack 605 causes relatively little visible light to be reflected from the MS-IMOD 600. This configuration may be referred to herein as a "black state." In some such implementations, the gap height 630 may be made larger or smaller than shown in FIG. 6D, in order to reinforce other wavelengths that are outside the visible range. Accordingly, the configuration of the MS-IMOD 600 shown in FIG. 6D provides merely one example of a black state configuration of the MS-IMOD 600.

Figure 6E:
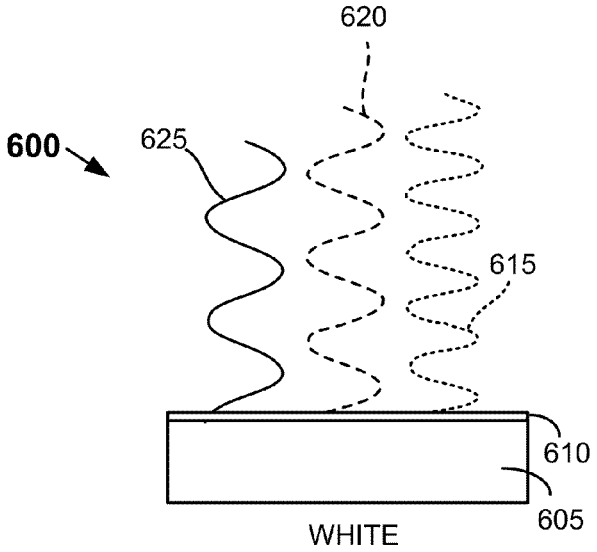

FIG. 6E depicts the MS-IMOD 600 in a configuration wherein the absorber stack 610 is in close proximity to the reflector stack 605. In this example, the gap height 630 is negligible because the absorber stack 610 is substantially adjacent to the reflector stack 605. Light having a broad range of wavelengths is reflected efficiently from the reflector stack 605 without being absorbed to a significant degree by the absorber stack 610. This configuration may be referred to herein as a "white state." However, in some implementations the absorber stack 610 and the reflector stack 605 may be separated to reduce stiction caused by charging via the strong electric field that may be produced when the two layers are brought close to one another. In some implementations, one or more dielectric layers with a total thickness of about $\lambda/2$ may be disposed on the surface of the absorber layer and/or the mirrored surface. As such, the white state may correspond to a configuration wherein the absorber layer is placed at the first null of the standing wave from the mirrored surface of the reflector stack 605.

Some MS-IMODs, such as A-IMODs, may be positioned in a substantially continuous manner in a large number of gap heights. However, other MS-IMODs may only be positioned in a smaller number of gap heights. Some may be 5-state MS-IMODs that can be positioned in gap heights corresponding to the primary colors red, green, blue, black and white. (As used herein, the terms "primary colors" or "primaries" may include not only red, green and blue, but also any of the other colors that correspond with positions of the MS-IMODs, including black and white.) Some MS-IMODs also may be configured in gap heights that correspond to other colors, such as yellow, orange, violet, cyan and/or magenta. Other MS-IMODs may be positioned in 8 or more gap heights, 10 or more gap heights, 16 or more gap heights, 20 or more gap heights, 32 or more gap heights, etc.

However, some MS-IMODs may not be positioned in a large enough number of gap heights to produce an acceptable set of renderable colors (a "color palette") without applying some type of temporal or spatial modulation method. Temporal and spatial modulation methods can produce a color palette that includes the primary colors and a plurality of colors that are intermediate between the primary colors. Temporal modulation may be employed to form combinations of primaries, leading to a larger palette. When an input image color does not correspond to any of the palette colors, spatial modulation may be used in addition to temporal modulation in order to approximate this color.

Spatial modulation and temporal modulation each have drawbacks. Specifically, spatial dithering leads to lower image resolution, because the colors of neighboring pixels (e.g., of neighboring MS-IMODs) are combined. While temporal modulation helps to reduce the amount of spatial modulation to be applied, the limited number of temporal slots that can be implemented on an MS-IMOD restricts the number of renderable colors in the color palette.

Temporal modulation methods generally involve modulating the length of time a pixel displays a given color thereby exploiting the averaging that the human eye performs for rapidly changing colors to generate an averaged color perceived by a viewer. For example, a pixel that is capable of displaying a certain hue of blue may be able to generate a hue of blue perceived to be darker than the hue the pixel is capable of generating intrinsically. This can be done by displaying blue for a certain portion of the time a frame is being displayed and displaying black for the remainder of the time the frame is displayed. By modulating in time (temporally), at a pixel level, the colors a pixel displays, a viewer can perceive a larger number of colors than the colors that the pixels is intrinsically capable of displaying. Temporal modulation methods described herein can entail controlling pixels or subpixels of a display to produce one or more of a predetermined number of colors during a fixed number of time slots, the duration of each time slot being predetermined. According to one example of a temporal modulation method, time slot durations may be given binary weighting: the time slot durations may be geometrically weighted according to the ratio one half $$\left(r = \frac{1}{2}\right).$$

For example, a temporal modulation method could include 4 binary-weighted time slots, as follows: [1, ½, ¼, ⅛]×8/15=[8/15, 4/15, 2/15, 1/15]. Other temporal modulation methods may include more or fewer time slots, and may involve different ratios. The ratios add up to 1, which corresponds to the duration of a frame of image data. The duration of a frame may be selected to prevent the introduction of artifacts such as flicker. In some implementations the duration of a frame may be on the order of $1/60^{th}$ of a second. Each of the numbers within the brackets refers to a "time slot," a unit of time that corresponds to part of a frame of image data.

For instance, for an MS-IMOD that can provide at least the three primary colors red, black and white, one choice of assigning time slots may be the following:

$$\text{Red: } \frac{2}{15}$$

$$\text{Black: } \frac{1}{15} + \frac{8}{15}$$

-continued $$\text{White: } \frac{4}{15}$$

This means that the MS-IMOD is positioned with a gap height corresponding to a red state for 2/15 of the frame duration, is positioned with a gap height corresponding to a black state for 9/15 of the frame duration and is positioned with a gap height corresponding to a white state for 4/15 of the frame duration.

The foregoing is simply an example. An MS-IMOD of a display device may be positioned in one configuration during the entire data frame or may be positioned at several different positions during a data frame, depending on the combination of MS-IMOD positions and time slots required to produce a desired color of the color palette.

Figure 7A:
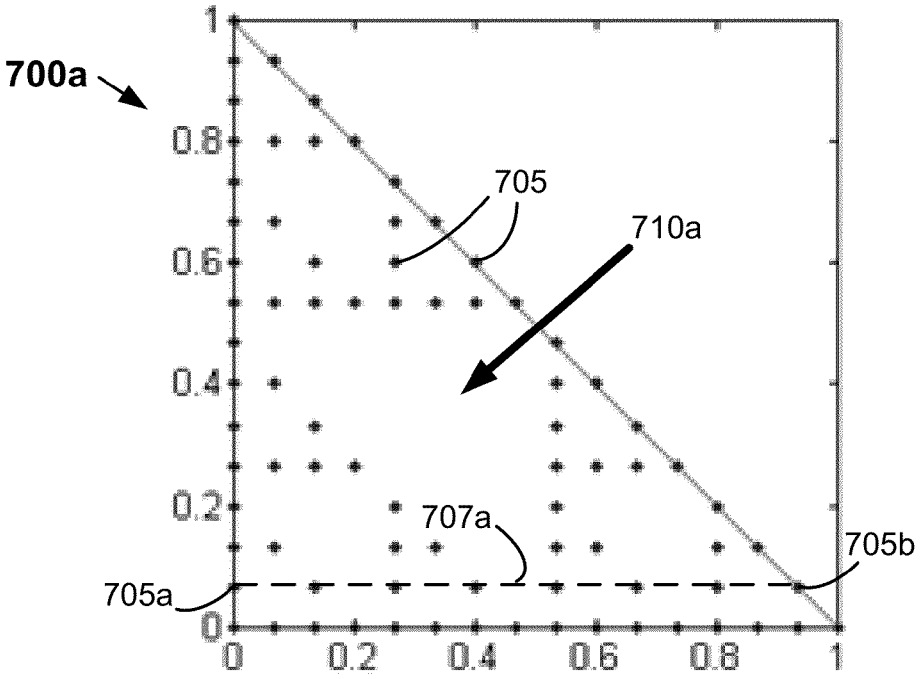
FIG. 7A shows a color palette for three primary colors corresponding to four binary-weighted time slots.

FIG. 7A shows a color palette for three primary colors corresponding to four binary-weighted time slots. In FIG. 7A, the three primary colors correspond to the three vertices of the triangle. For example, if the three primary colors were red, blue and black, the vertical axis could correspond to red, and the horizontal axis could correspond to blue.

The values along each axis correspond to time slots for a primary color. Each axis has a maximum value of one, which corresponds to having the MS-IMOD positioned in a gap height corresponding to that color for a time slot of "1," a time corresponding to an entire frame of image data. In this example, the value of one on the vertical axis would correspond to having the MS-IMOD positioned in a gap height corresponding to a red color for the entire frame.

The other color palette values 705 correspond to other combinations of the time slots 8/15, 4/15, 2/15 and 1/15, expressed in decimal form. For example, the color palette values 705 along the line 707*a* correspond to configuring the MS-IMOD in a red state for a time slot of 1/15 of a frame while varying the time slot during which the MS-IMOD is configured in a blue state from zero (at the color palette value 705*a*) to 14/15 of the frame (at the color palette value 705*b*).

In this example, during the remaining portion of the frame, if any, the MS-IMOD is configured in a black state. For example, at the color palette value 705*a* the MS-IMOD is configured in a red state for 1/15 of the frame and is configured in a black state for 14/15 of the frame. At the color palette value 705*b*, the MS-IMOD is configured in a red state for 1/15 of the frame and is configured in a blue state for 14/15 of the frame. There is no remaining time during the frame for the MS-IMOD to be configured in a black state.

As shown in FIG. 7A, the color palette 700*a* formed using this set of time slots contains holes or voids, such as the void indicated by the arrow 710*a*. In prior implementations, such holes may have meant that spatial dithering would be used to better approximate the desired color output. Spatial dithering can cause significant quantization errors when rendering colors that lie in these voids, which are seen as dither artifacts in the display. Although the specific set of colors that lies within these voids depends on the primaries chosen, the inventors' experiments with MS-IMODs has revealed that, for example, skin tone colors may lie within voids such as those shown in FIG. 7A. Humans tend to be especially sensitive to how skin tones are rendered. Therefore, using the corresponding binary temporal modulation method (wherein time slot durations are geometrically weighted according to the ratio one half $$\left(r = \frac{1}{2}\right))$$

may produce significant dither artifacts when rendering images that contain skin tones. These artifacts may be readily apparent to human viewers.

Figure 7B:
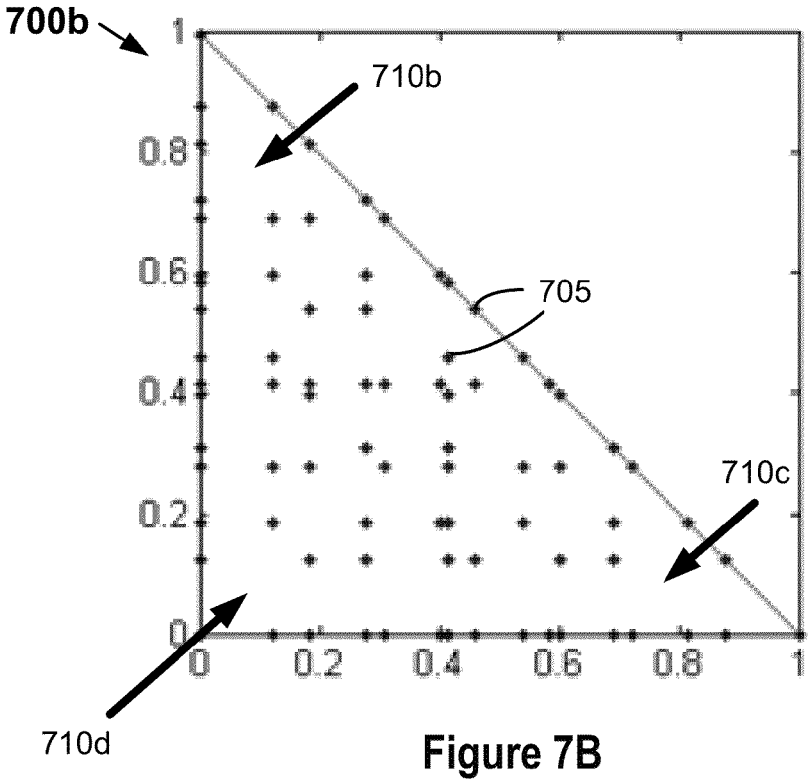
FIG. 7B shows an alternative color palette for three primary colors corresponding to four time slots and a different ratio.

FIG. 7B shows an alternative color palette for three primary colors corresponding to four time slots and a different ratio. In this example, the ratio is two thirds $$\left(r = \frac{2}{3}\right).$$

The four time slots are as follows: [1, ⅔, 4/9, 8/27]×27/65=[27/65, 18/65, 12/65, 8/65].

Unlike the color palette 700*a*, the color palette 700*b* does not have a large central void. Moreover, the distribution of color palette values 705 is generally more uniform in the color palette 700*b* than in the color palette 700*a*. However, the color palette 700*b* includes more empty regions near the primary colors, as indicated by the arrows 710*b*, 710*c* and 710*d*. In other words, time slots with ratio r=½ do not render colors well in the interior of the color palette (e.g., skin tone colors), but they render colors near primaries (for example, black or red) better than the time slots with ratio r=⅔.

This observation suggests that for any given frame of image data, there is a temporal modulation method (corresponding to a choice of time slots) that renders colors more accurately overall in that frame. By analyzing image data and adaptively choosing the temporal modulation method based on the image analysis, one may significantly reduce dither visibility in the image(s).

Figure 8:
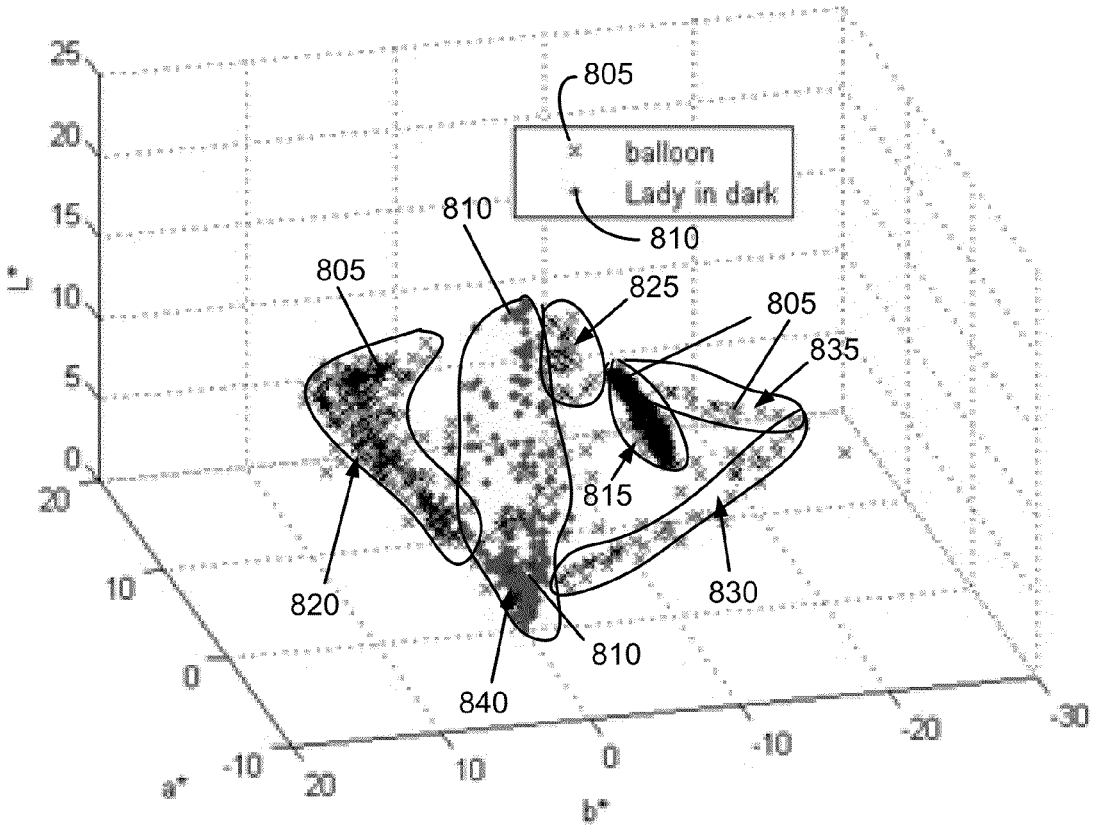
FIG. 8 is a graph that shows image gamut distributions for two images.

FIG. 8 is a graph that shows image gamut distributions for two images. With reference to FIG. 8, the "image gamut" is the set of colors within an image at a given time (illustrated in CIELAB color space). The values 805 correspond to an image of a brightly-colored hot air balloon in a blue sky. The balloon is composed of red, orange, yellow, green, blue and violet rectangles. The values 810 correspond to an image of a woman dressed in black, seated in a red chair, with a dark background.

The values 805 and 810 tend to cluster in different regions of the CIELAB color space. The values 805 are concentrated in the regions 815, 820 and 825, and to a lesser extent in regions 830 and 835. The values 810 cluster mainly in the region 840. Although some of the values 810 extend into the region 820, along with the values 805, the image gamut distributions for these two images occupy distinctive regions of the CIELAB color space. As noted above with reference to FIGS. 7A and 7B, some temporal modulation methods would render colors within these regions of the CIELAB color space more accurately than other temporal modulation methods. As such, image gamut distributions may be mapped to temporal modulation methods (or vice versa) to allow more accurate rendering of images.

According to some implementations, an apparatus may include a control system that is configured to analyze the image gamut distribution of one or more input image data frames. One such apparatus will now be described with reference to FIG. 9.

Figure 9:
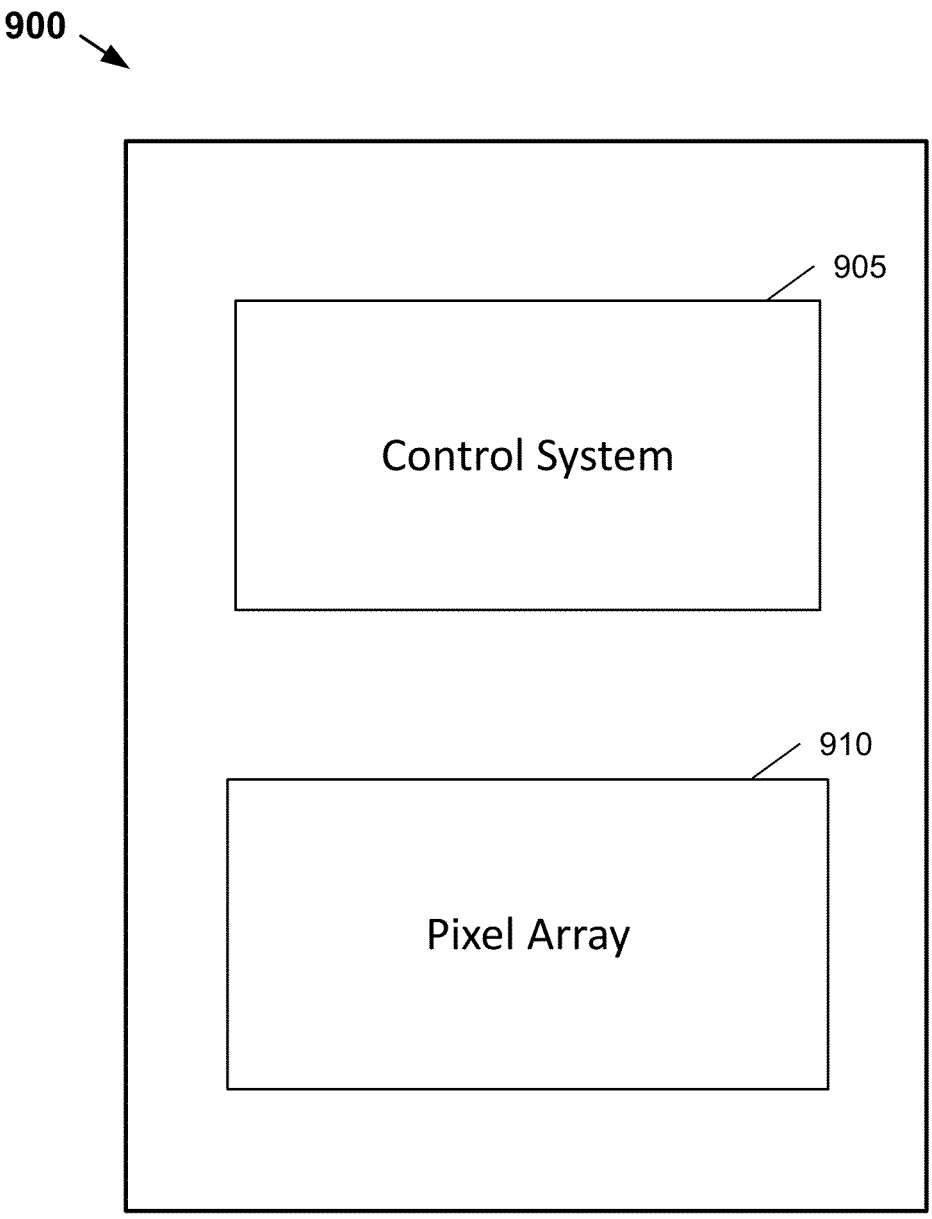
FIG. 9 is a block diagram of an apparatus that includes a control system and an array of pixels.

FIG. 9 is a block diagram of an apparatus that includes a control system and an array of pixels. The apparatus 900 may, for example, be a display device such as the display device 40 that is described below with reference to FIGS. 12A and 12B. In this example, the apparatus 900 includes a control system 905 and a pixel array 910. The pixel array 910 includes a plurality of pixels, each of which may be configured to produce a plurality of primary colors including black. The pixels may, for example, be MS-IMODs.

The control system 905 may include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. The control system 905 may be configured for receiving image data and for analyzing the image data to produce image analysis data. The control system 905 may be configured for selecting a temporal modulation method according to the image analysis data.

The analyzing process may differ substantially according to the particular implementation. In some implementations, the analyzing process may involve analyzing image gamut data. Referring again to the image gamut distributions of FIG. 8, it will be appreciated that such data could be characterized and/or analyzed in a number of different ways. For example, the analyzing process may involve determining an image gamut distribution of the image data and sampling the image gamut distribution to produce an image gamut data volume.

The selecting process may involve comparing the image gamut data volume with a plurality of color palette data volumes. Each of the color palette data volumes may correspond to a temporal modulation method. One method of selecting among the possible choices of temporal time slots is to compute the quantization error in CIELAB space for each image pixel color. CIELAB space is generally taken to be a perceptually uniform color space, unlike sRGB space. Different temporal modulation methods yield different colors palettes, resulting in different sets of quantization errors. The particular choice of temporal slot durations may be chosen to minimize the mean or median of this set of quantization errors. Furthermore, to reduce the computational cost of the search, instead of considering all image pixel colors, a smaller sample of the image data may be selected. More generally, by considering the distribution of quantization errors of a sample of input image colors in CIELAB space, a search in the space of possible time slots would yield a particular choice that leads to least overall quantization errors, and therefore, least dither artifacts.

Alternative methods may be used for comparing image gamut data volumes with color palette data volumes. For example, some methods may involve a perceptual analysis of image content. Some such methods are known. For instance, a color appearance model such as iCAM (developed by Mark D. Fairchild and Garrett M. Johnson published in 2002 at the IS&T/SID 10th Color Imaging Conference in Scottsdale) may be used to characterize features of at least part of an image.

Note that although the previous examples only considered temporal time slots that are in constant ratio $$\left(\text{for example } r = \frac{1}{2} \text{ or } r = \frac{2}{3}\right),$$

in general, each time slot duration may be chosen independently of the rest. For instance, once choice in the space of possible time slots that does not follow a geometric progression is [0.1, 0.2, 0.3, 0.4]. With N time slots and one constraint that the time slots must add up to one, the dimension of the search space would be N−1 (there are N−1 free parameters that must be chosen). A further reduction in the computational cost of the search may be achieved by reducing the dimensions of the search space. One way of achieving this is to reduce the dimensionality to of the search space to one, by limiting the in some implementations the plurality of temporal modulation methods and their associated color palette data volumes may be limited to a set of geometrically-weighted time slot values, as follows:

$$\text{time slots}=[1,r,r^2,r^3,\ldots,r^{N-1}],\ 0<r<1,$$

where N is the number of temporal planes and r is the ratio of the duration of consecutive time slots when arranged in decreasing order. This assumption reduces computation by restricting the search space to only 1 dimension of r (without this assumption, the search space would have dimension N). Nonetheless, by varying $r\in(0,1)$ one may obtain a varied set of color palette data volumes that can be mapped to image gamut data volumes corresponding to image analysis data.

The sampling parameters may be selected according to performance criteria such as processing speed and/or accuracy. Generally speaking, the more samples, the more data will be processed and therefore the longer the processing time. Referring to FIG. 8, it may be observed that the image gamut distributions for these two images could be differentiated with a relatively small number of data points or samples. The small number of data points may, for example, be obtained by using a relatively large sample volume within the color space. For example, if a sample volume were 10 units along the a* axis, 10 units along the b* axis and 5 units along the L* axis, this would be a sufficiently small sample volume to distinguish the image gamut distributions shown. Other implementations could use a larger or smaller sample volume. The size of the sample volume also may be based, at least in part, on an average spacing between color palette values in the color palette data volumes.

Some implementations may involve determining the number of color palette values or image gamut values within each sample volume. Other implementations may involve determining the density of color palette values or image gamut values within each sample volume. In some such implementations, the number or density of values may be converted into a rank or scale factor, e.g., from 1 to 5, from 0 to 9, etc. A linear or non-linear scale may be applied. For example, a sample volume that includes the highest density or largest number of values may correspond to a scale factor of 9, whereas a sample volume that includes no values may correspond to a scale factor of zero.

The values, densities and/or scale factors of color palette data volumes may be mapped to those of image gamut data volumes in various ways. For example, a scale factor for each sample volume of a color palette data volume may be multiplied by a corresponding scale factor for each sample volume of an image gamut data volume. Voids in a color palette data volume or an image gamut data volume would result in zero values in the sample volumes corresponding to the void. These zero values would result in zero scores when multiplied by any value. Conversely, if corresponding sample volumes for both the color palette data volume and the image gamut data volume have high scale factors, a large value would result. The large value would indicate a correspondence or match between sample volumes of the color palette data volume and the image gamut data volume. The resulting products could be summed to produce a total value.

However, various other methods may be used for comparing color palette data volumes and image gamut data volumes. In some implementations, the analyzing process may involve minimizing the mean $\Delta E^*_{ab}$ across the image, where $\Delta E^*_{ab}$ refers to the distance in CIELAB space from a give image color to the nearest color palette value in a color palette data volume. By minimizing this distance metric, the average quantization error may be minimized across the image in a perceptually uniform color space. In some implementations, the optimal color palette data volume may be found by varying r from 0 to 1 in discrete steps and determining the ratio which leads to the least average $\Delta E^*_{ab}$.

Figure 10:
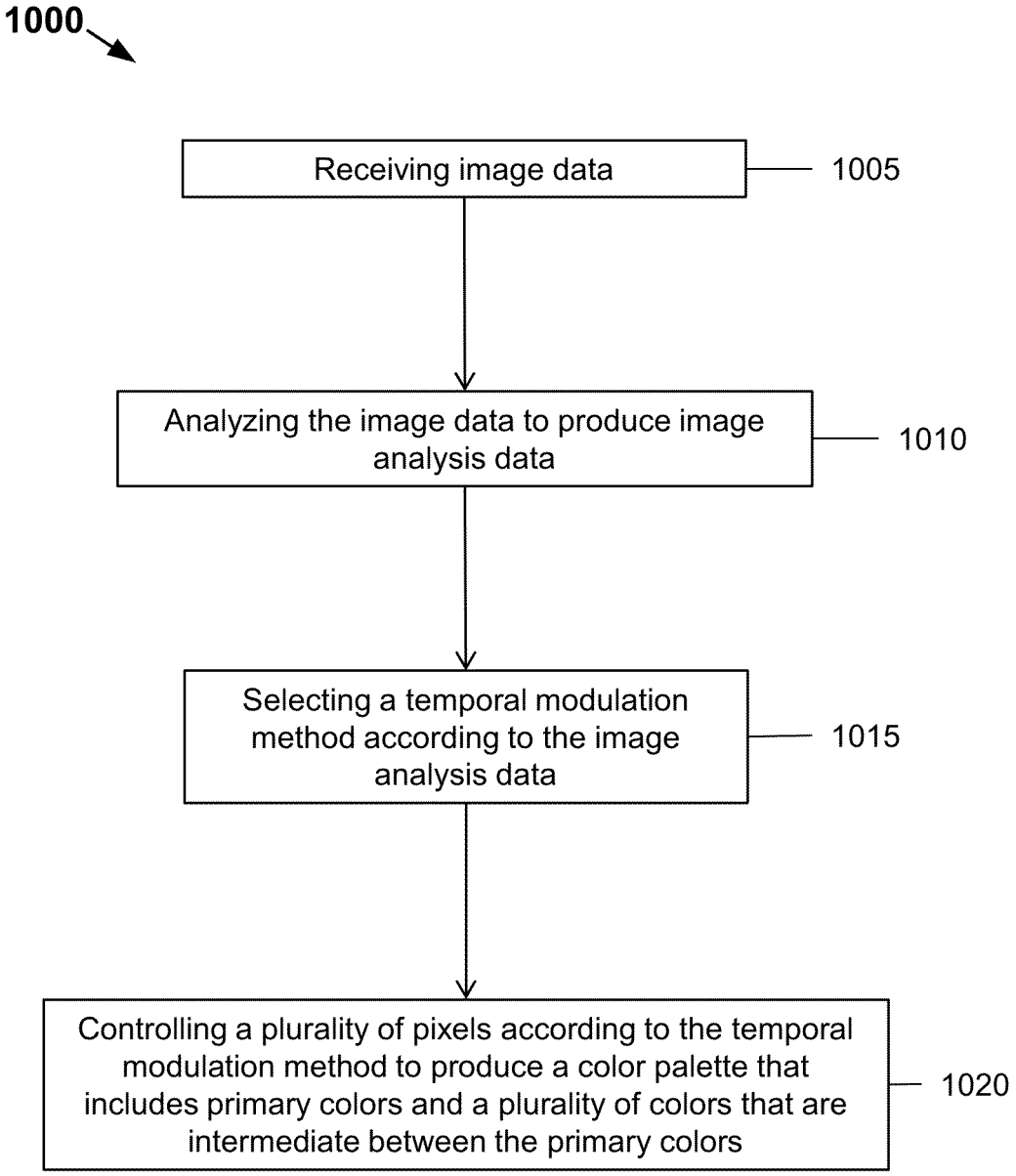
FIG. 10 is a flow diagram that outlines a method of controlling a pixel array according to selected temporal modulation methods.

Some alternative methods will now be described with reference to FIGS. 10 and 11. FIG. 10 is a flow diagram that outlines a method of controlling a pixel array according to selected temporal modulation methods. In this example, image data are received in block 1005. The image date may, for example, be received by a control system such as the control system 905 (see FIG. 9).

Here, block 1010 involves analyzing the image data to produce image analysis data. In some implementations, the analyzing process may be similar to that described with reference to FIG. 9. In some instances, however, merely analyzing the image gamut distribution may not produce the best results. Therefore, alternative analyzing processes will be described below with reference to FIG. 11.

In this implementation, block 1015 involves selecting a temporal modulation method according to the image analysis data and block 1020 involves controlling a plurality of pixels according to the temporal modulation method. In some implementations, the temporal modulation method may correspond to time slots that are geometrically weighted according to a particular ratio $$\left(\text{for example, } r=\frac{1}{2} \text{ or } r=\frac{2}{3}\right),$$

as described above in reference to FIGS. 7A and 7B. According to some such implementations, selecting a temporal modulation method may involve selecting between two or more different time slot ratios. As described above, however, some temporal modulation methods involve time slots that do not follow a geometric progression (for example, [0.1, 0.2, 0.3, 0.4]). Accordingly, in some implementations block 1015 may involve selecting between more than two different temporal modulation methods, not all of which necessarily involve time slots that follow a geometric progression. The controlling process may produce a color palette that includes primary colors and a plurality of colors that are intermediate between the primary colors.

Figure 11:
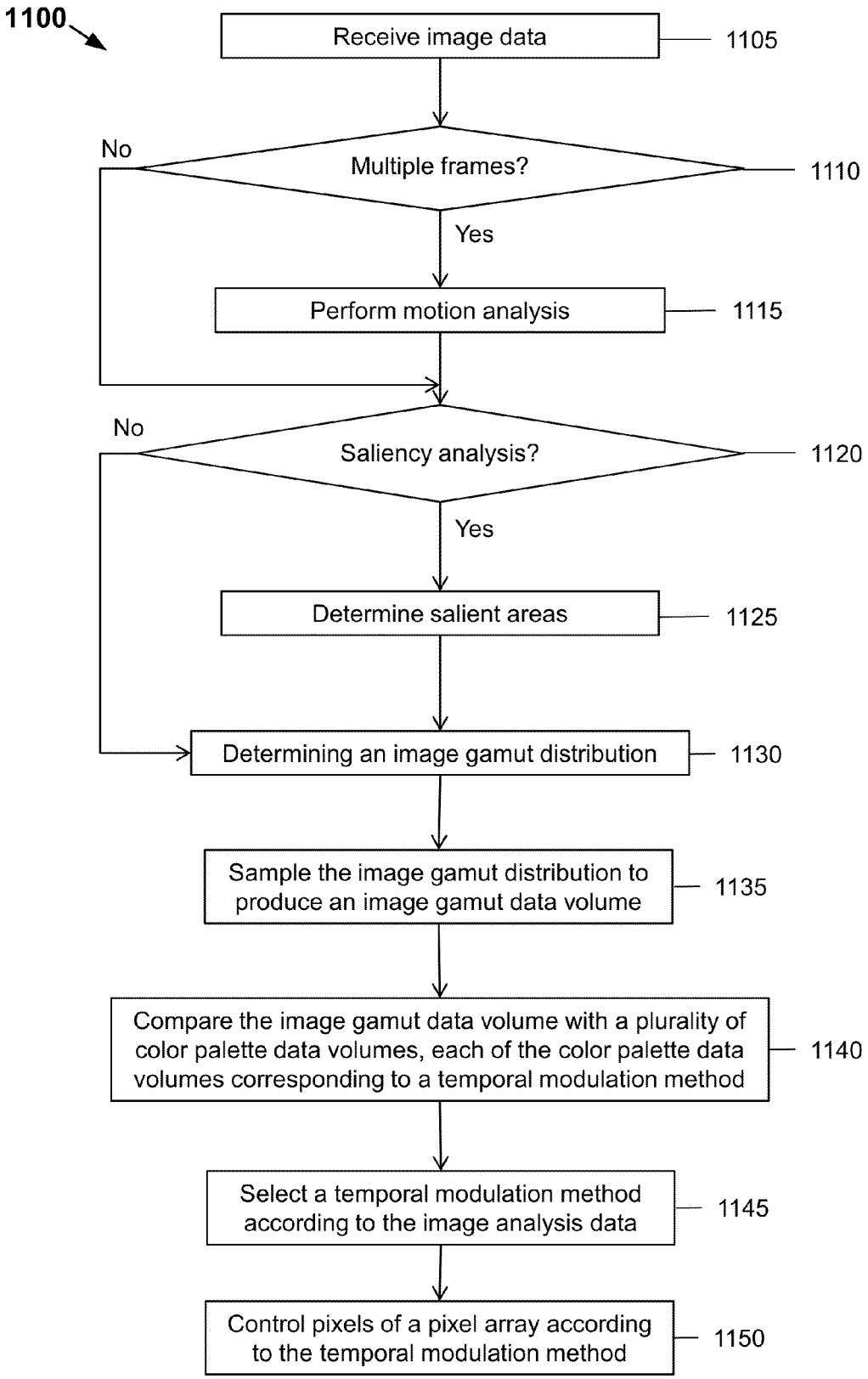
FIG. 11 is a flow diagram that outlines an alternative method of controlling a pixel array according to selected temporal modulation methods.

FIG. 11 is a flow diagram that outlines an alternative method of controlling a pixel array according to selected temporal modulation methods. Here, image data are received in block 1105. In block 1110, it is determined (e.g., by a control system such as the control system 905) whether to analyze multiple frames to determine a single temporal modulation method. The determination of block 1110 may, for example, be based on user input or on whether the image data correspond to still images or video data. If so, in this example the analyzing process includes a motion analysis of one or more objects in the multiple frames of image data (block 1115). According to some such implementations, if one or more moving objects are identified, a temporal modulation method may be selected, at least in part, based on the image gamut distribution of the one or more moving objects.

As noted above, merely analyzing an image gamut distribution may not produce the best results in some circumstances. For example, a large portion of the image may represent a background (such as a grassy field, a sky, a garden, etc.) that may be less important, or salient, to a viewer than other portions of the image that include human or animal figures. Therefore, some implementations involve an analysis of image content.

In this example, it is determined in block 1120 whether to perform a saliency analysis on the image data. This determination may be made, at least in part, according to user input, according to whether a prior saliency analysis of recently-received image data indicated salient features, or according to other criteria. If no saliency analysis is performed, an image gamut distribution may be determined without reference to salient features that may be in the image(s). (Block 1130.) However, if one or more moving objects were identified in block 1115, an image gamut distribution may be determined of the one or more moving objects.

If a saliency analysis is performed, the most salient areas of the image(s) may be determined in block 1125. The saliency analysis may, for example, involve analyzing image data using pattern recognition software, such as facial recognition software. More specifically, since the human eye is particularly sensitive to the colors of skin and hair, it may be desirable to choose the time slots so as to render the colors in these regions as closely as possible (for example, with least quantization error). To achieve this, for instance, if a facial recognition algorithm detects a face in the image, the pixel color data corresponding to the skin and hair regions could be given higher priority when performing the search. Block 1130 may involve determining an image gamut distribution of the salient areas.

Here, block 1135 involves sampling the image gamut distribution to produce an image gamut data volume. In block 1140, the image gamut data volume may be compared with a plurality of color palette data volumes. Each of the color palette data volumes may correspond to a temporal modulation method. A temporal modulation method may be selected according to the image analysis data (block 1145). Pixels of a pixel array may be controlled according to the temporal modulation method (block 1150).

Figure 12A:
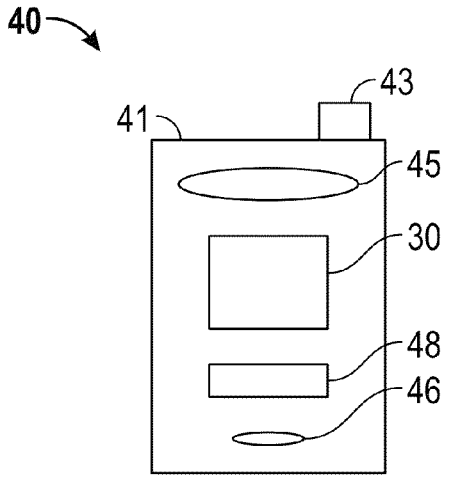
FIGS. 12A and 12B are system block diagrams illustrating a display device 40 that includes a plurality of IMOD display elements.
Figure 12B:
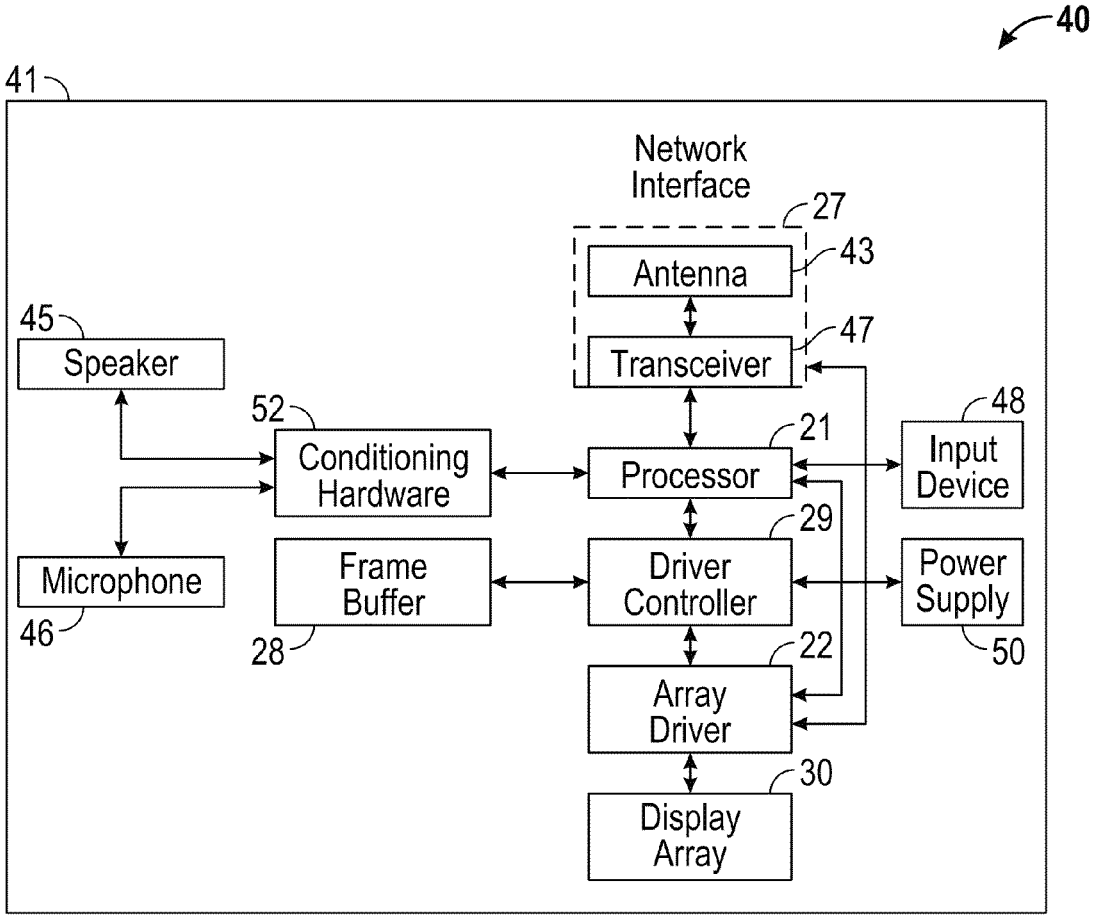

FIGS. 12A and 12B are system block diagrams illustrating a display device 40 that includes a plurality of IMOD display elements. In some implementations, the IMOD display elements may be MS-IMOD display elements as described elsewhere herein. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an IMOD-based display. The display may include MS-IMODs such as those described herein.

The components of the display device 40 are schematically illustrated in FIG. 12A. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 12A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. In some implementations, the processor 21 may correspond with, or form a component of, the control system 905 of FIG. 9. Accordingly, in some implementations, the processor 21 may be configured to perform, at least in part, the methods described herein. For example, the processor 21 may be configured to analyze image data to produce image analysis data. The processor 21 may be configured to select a temporal modulation method based at least in part on the image analysis data. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements.

In some implementations, the driver controller 29, the array driver 22, and the display array 30 are appropriate for any of the types of displays described herein. For example, the driver controller 29 can be a conventional display controller or a bi-stable display controller (such as an IMOD display element controller). Additionally, the array driver 22 can be a conventional driver or a bi-stable display driver (such as an IMOD display element driver). Moreover, the display array 30 can be a conventional display array or a bi-stable display array (such as a display including an array of IMOD display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above also may be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of, e.g., an IMOD display element as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A display device, comprising:

an array of pixels, each of the pixels being configured to produce a plurality of primary colors including black, wherein the pixels include multi-state interferometric modulators (MS-IMODs); and a control system configured for:

receiving image data;

analyzing the image data to produce image analysis data;

selecting a temporal modulation method based at least in part on the image analysis data; and controlling the pixels according to the temporal modulation method to produce a color palette that includes the primary colors and a plurality of colors that are intermediate between the primary colors.

2. The display device of claim 1, wherein the analyzing process involves analyzing at least one of image content data or image gamut data.

3. The display device of claim 1, wherein the control system is configured for selecting the temporal modulation method based on receiving and analyzing a single frame of image data.

4. The display device of claim 1, wherein the control system is configured for selecting the temporal modulation method based on receiving and analyzing multiple frames of image data.

5. The display device of claim 4, wherein the analyzing process includes a motion analysis of one or more objects in the multiple frames of image data.

6. The display device of claim 1, wherein the analyzing process involves:

determining an image gamut distribution of the image data; and sampling the image gamut distribution to produce an image gamut data volume.

7. The display device of claim 6, wherein the selecting process involves comparing the image gamut data volume with a plurality of color palette data volumes, each of the color palette data volumes corresponding to a temporal modulation method.

8. The display device of claim 1, wherein the analyzing process involves:

performing a saliency analysis on the image data to determine salient areas; and determining an image gamut distribution of the salient areas.

9. The display device of claim 8, wherein the salient areas correspond to features of a human or animal.

10. The display device of claim 9, wherein the features include facial features.

11. The display device of claim 1, wherein selecting a temporal modulation method involves accessing a look-up table that includes data corresponding to a plurality of temporal modulation methods.

12. The display device of claim 1, wherein the control system further comprises:

a processor;

a driver circuit configured to send at least one signal to a display of the display device; and a controller configured to send at least a portion of the image data to the driver circuit.

13. The display device of claim 12, wherein the control system further comprises:

an image source module configured to send the image data to the processor, wherein the image source module includes at least one of a receiver a transceiver or a transmitter.

14. The display device of claim 1, further comprising:

an input device configured to receive input data and to communicate the input data to the control system.

15. A display device, comprising:

an array of display elements configured to produce two or more primary colors, wherein the display elements include multi-state interferometric modulators (MS-IMODs) and wherein each primary color has a fixed grey level without temporal modulation and wherein the grey level of each primary color may be adjusted using temporal modulation; and a control system configured for:

receiving image data;

analyzing the image data to produce image analysis data;

selecting a temporal modulation method based at least in part on the image analysis data; and controlling the display elements according to the temporal modulation method to produce a color palette that includes the primary colors and a plurality of colors that are intermediate between the primary colors.

16. The display device of claim 15, wherein the analyzing process involves analyzing at least one of image content data or image gamut data.

17. The display device of claim 15, wherein the analyzing process involves determining an image gamut distribution of the image data and sampling the image gamut distribution to produce an image gamut data volume, and wherein the selecting process involves comparing the image gamut data volume with a plurality of color palette data volumes, each of the color palette data volumes corresponding to a temporal modulation method.

18. A method, comprising:

receiving image data;

analyzing the image data to produce image analysis data;

selecting a temporal modulation method based at least in part on the image analysis data; and controlling a plurality of pixels according to the temporal modulation method to produce a color palette that includes primary colors and a plurality of colors that are intermediate between the primary colors, wherein the pixels include multi-state interferometric modulators (MS-IMODs).

19. The method of claim 18, wherein the analyzing process involves analyzing at least one of image content data or image gamut data.

20. The method of claim 18, wherein the analyzing process involves:

determining an image gamut distribution of the image data; and sampling the image gamut distribution to produce an image gamut data volume.

21. The method of claim 20, wherein the selecting process involves comparing the image gamut data volume with a plurality of color palette data volumes, each of the color palette data volumes corresponding to a temporal modulation method.

22. The method of claim 18, wherein the analyzing process involves:

performing a saliency analysis on the image data to determine salient areas; and determining an image gamut distribution of the salient areas.

23. A display device, comprising:

an array of pixels, each of the pixels being configured to produce a plurality of primary colors including black, wherein the pixels include multi-state interferometric modulators (MS-IMODs); and control means for:

receiving image data;

analyzing the image data to produce image analysis data;

selecting a temporal modulation method based at least in part on the image analysis data; and controlling the pixels according to the temporal modulation method to produce a color palette that includes the primary colors and a plurality of colors that are intermediate between the primary colors.

24. The display device of claim 23, wherein the analyzing process involves determining an image gamut distribution of the image data and sampling the image gamut distribution to produce an image gamut data volume, and wherein the selecting process involves comparing the image gamut data volume with a plurality of color palette data volumes, each of the color palette data volumes corresponding to a temporal modulation method.

25. A non-transitory medium having software stored thereon, the software including instructions for controlling a display device to:

receive image data;

analyze the image data to produce image analysis data;

select a temporal modulation method based at least in part on the image analysis data; and control a plurality of pixels according to the temporal modulation method to produce a color palette that includes primary colors and a plurality of colors that are intermediate between the primary colors, wherein the pixels include multi-state interferometric modulators (MS-IMODs).

26. The non-transitory medium of claim 25, wherein the analyzing process involves analyzing at least one of image content data or image gamut data.

27. The non-transitory medium of claim 25, wherein the analyzing process involves determining an image gamut distribution of the image data and sampling the image gamut distribution to produce an image gamut data volume, and wherein the selecting process involves comparing the image gamut data volume with a plurality of color palette data volumes, each of the color palette data volumes corresponding to a temporal modulation method.

* * * * *